US005862240A

United States Patent [19]

Ohkubo et al.

[11] Patent Number: 5,862,240

[45] Date of Patent: Jan. 19, 1999

[54] MICROPHONE DEVICE

[75] Inventors: Masashi Ohkubo, Kanagawa; Toru Sasaki, Tokyo, both of Japan

[73] Assignee: Sony Corporation, Tokyo, Japan

[21] Appl. No.: 960,099

[22] Filed: Oct. 27, 1997

Related U.S. Application Data

[63] Continuation of Ser. No. 704,756, Sep. 25, 1996, abandoned.

[30] Foreign Application Priority Data

Feb. 10, 1995 [JP] Japan ..... 7-023123

[51] Int. Cl.[6] ..... H04R 25/00; H04R 3/00

[52] U.S. Cl. ..... 381/356; 381/92; 381/122; 381/338; 381/357

[58] Field of Search ..... 381/26, 87, 91, 381/92, 95, 111, 122, 338, 355, 356, 357, 361, 375, 142, 147, 148; 181/158, 144–5

[56] References Cited

U.S. PATENT DOCUMENTS

| | | | |
|---|---|---|---|
| 3,573,400 | 4/1971 | Sessler | 381/155 |
| 4,206,324 | 6/1980 | Horikawa et al. | 381/91 |
| 4,311,874 | 1/1982 | Wallace, Jr. | 381/92 |
| 4,354,059 | 10/1982 | Ishigaki et al. | 381/92 |
| 4,393,270 | 7/1983 | Van Den Berg | 381/356 |
| 4,412,097 | 10/1983 | Ishigaki et al. | 381/92 |
| 4,489,442 | 12/1984 | Anderson et al. | 381/92 |
| 4,559,042 | 12/1985 | Miyaji | 381/92 |
| 4,559,642 | 12/1985 | Miyaji et al. | 381/92 |
| 5,208,864 | 5/1993 | Kaneda | 381/92 |
| 5,500,903 | 3/1996 | Caulli | 381/92 |
| 5,511,130 | 4/1996 | Bartlett et al. | 381/169 |
| 5,539,834 | 7/1996 | Bartlett et al. | 381/168 |
| 5,675,655 | 10/1997 | Hatae | 381/111 |
| 5,778,083 | 7/1998 | Godfrey | 381/92 |

FOREIGN PATENT DOCUMENTS

| | | | |
|---|---|---|---|
| 2066620 | 7/1981 | United Kingdom | 381/92 |

*Primary Examiner*—Curtis A. Kuntz
*Assistant Examiner*—Xu Mei
*Attorney, Agent, or Firm*—Jay H. Maioli

[57] ABSTRACT

A microphone device is of a structure comprising at least three microphone elements disposed in the state spaced by predetermined distances in a direction perpendicular to the main axis of directivity, and an adder for adding output signals from the respective microphone elements. In this case, the microphone elements are respectively comprised of uni-directional microphone elements, and are disposed in the state where the sound collection surfaces are directed in the same direction with respect to the sound source and at substantially equal intervals. This microphone device realizes sharp directivity in the middle pitched tone (sound) region (range) required for the input means of the speech recognition equipment, and realizes sound collection which has high sensitivity with respect to speech (voice) input from the front and has extremely less noise components inputted from the side surfaces (lateral direction).

7 Claims, 9 Drawing Sheets

MICROPHONE DEVICE

This is a continuation of application Ser. No. 08/704,756 filed Sep. 25, 1996, now abandoned.

TECHNICAL FIELD

This invention relates a microphone device in which directivity with respect to the sound source has been improved, and more particularly to a microphone device useful when used as voice input means of speech (voice) recognition equipment used in the car navigation system or computer, etc. in which inputting of various command signals is carried out by utilizing voice.

BACKGROUND ART

Generally, microphone devices used for carrying out collection of sound radiated from the sound source are required to have various directivities in dependency upon use purposes.

In view of the above, as the conventional microphone devices, there are a non-directional microphone device having fixed sensitivity also with respect to sound sources located in all directions, and a directional microphone device having fixed sensitivity with respect to a sound source located in a fixed direction. As the directional microphone device, a uni-directional microphone device in which sensitivity in the main axis direction of the directivity of the microphone unit is caused to be 1 and sensitivity in a direction perpendicular to the main axis is caused to be 0.5, and a ultra directional microphone device in which sensitivity in a direction perpendicular to the main axis of the microphone unit is caused to be 0.5 or less are provided.

As the microphone device having ultra directional property (directivity), there are known so called a shot-gun type microphone device which is the uni-directional type microphone device in which the microphone unit is attached to one end of a cylindrical sound (acoustic) tube having through holes or slits for sound collection bored at the peripheral surface thereof with the main axis of direction of the directivity being directed to the axis direction of the sound tube, and a microphone device of the secondary sound pressure gradient type in which two uni-directional microphone units are linearly arranged in the main axis direction.

The above-described so called shot-gun type microphone device presents (exhibits) ultra directional property (directivity) mainly in the high-pitched tone (sound) region (range), whereas the secondary sound pressure gradient type microphone device presents the ultra directional property (directivity) mainly in the low-pitched tone (sound) region (range).

Meanwhile, since the microphone devices used for voice (speech) input means of the speech (voice) recognition equipment used in the car navigation system or computer, etc. in which inputting of various command signals is carried out by utilizing voice are used with a view to exclusively collecting only voice of the human being subject to speech recognition, sharp directivity is required in the middle-pitched tone region (range).

Further, the uni-directional microphone devices conventionally used are such that noises from the side surface (lateral) direction except for the direction to which the main axis of the directivity direction of the microphone unit is directed are apt to be mixed. Therefore, such microphone devices are not suitable for use in the voice input means of the speech recognition equipment. Namely, since sounds except for sounds to be primarily collected would be collected, precise command signals could not be obtained.

In addition, the shot-gun type microphone device and/or the secondary sound pressure gradient type microphone device have the problems that not only it is impossible to satisfy sharp directivity in the middle pitched tone (sound) region (range) required for the voice input means of the speech recognition equipment, but also such devices are expensive.

DISCLOSURE OF THE INVENTION

An object of this invention is to solve the problems that the conventional microphone devices have, thus to provide a microphone device useful when used for the voice input means of the speech recognition equipment.

Another object of this invention is to provide a microphone device which realizes sharp directivity in the medium pitched tone region (range) required for the input means of the speech recognition equipment, and realizes collection of sound which exhibits high sensitivity with respect to voice input from the front and has extremely less noise components inputted from the side surfaces.

A microphone device according to this invention proposed in order to attain objects as described above comprises at least three directional microphone elements disposed within a substantially single horizontal plane and substantially equidistantly disposed at distances substantially equal to each other from a sound source and in the state directed to the sound source, and an adder for adding output signals from the respective microphone elements.

In this case, the respective microphone elements are disposed within a single plane in parallel to vibrating plates of the respective microphone elements. In addition, uni-directional microphone element is used for the respective microphone elements.

Moreover, a microphone device according to this invention comprises at least three microphone elements disposed in the state spaced by predetermined distances in a direction perpendicular to the main axis of directivity, and an adder for adding output signals from the respective microphone elements. In this case, the microphone elements are respectively comprised of uni-directional microphone elements, and are disposed in the state where their sound collection surfaces are directed in the same direction with respect to a sound source and they are equi-distant.

Further, a microphone device according to this invention comprises a single microphone element, and at least three sound guide paths which are equal to each other in length and are adapted for guiding sound incoming from the external to the microphone element. Further, opening portions of respective one ends of the three sound guide paths are disposed so that distances from a sound source are caused to be equal to each other and a single horizontal plane is formed, and opening portions of the respective other end sides are opposed to the microphone element. In this case, the opening portions of the respective one ends of the three sound guide paths are disposed so as to form a plane substantially perpendicular to the single horizontal plane.

In this microphone device, non-directional microphone element is used as the microphone element.

Further, uni-directional microphone element may be used as the microphone element.

In addition, there may be provided a sound guide portion in which three sound guide paths are provided at the front in the sound collection surface direction of the microphone element.

Still further objects of this invention and advantages obtained by this invention will become more clear from the description of the embodiments which will be explained below with reference to the attached drawings.

BEST MODE FOR CARRYING OUT THE INVENTION

More practical embodiments of a microphone device according to this invention will now be described with reference to the attached drawings.

Figure 1:
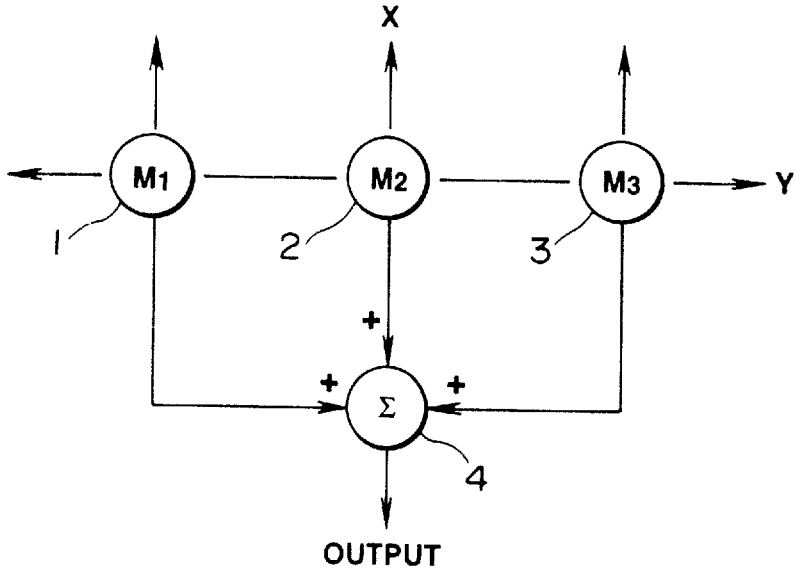
FIG. 1 is a block diagram showing the configuration of a microphone device according to this invention.

The microphone device according to this invention comprises, as shown in FIG. 1, three microphone units 1, 2, 3, and a synthesis element 4 for carrying out additive synthesis of outputs from these microphone units 1, 2, 3.

Figure 2:
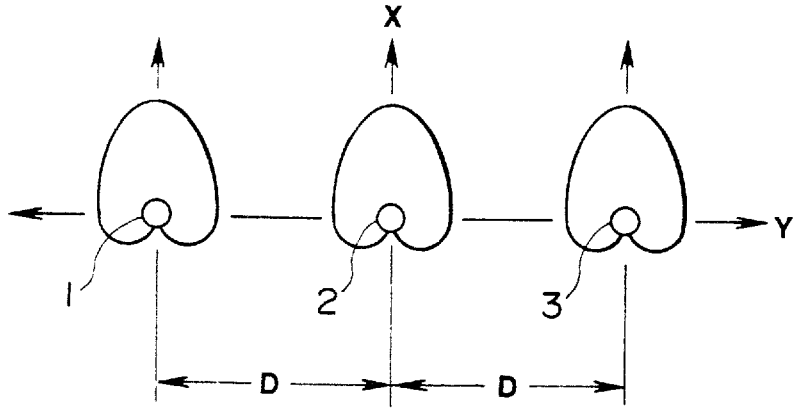
FIG. 2 is a plan view showing, in a model form, the positional relationship of respective microphone units and respective directivities in the microphone device.

As the respective microphone units 1, 2, 3, microphone unit which exhibits uni-directional property (characteristic) are used as shown in FIG. 2. In this case, the respective microphone units 1, 2, 3 are disposed at equal spacings (distances) D in a direction perpendicular to the main axis of directivity direction. In this example, the spacings D between the respective microphone units 1, 2, 3 are set so that they fall within the range of, e.g., about 3 cm to 12 cm. The spacings D between the respective microphone units 1, 2, 3 are suitably selected in correspondence with the size of the microphone unit used and/or the sound source used for sound correction, and are not therefore limited to the above-described range. Moreover, the respective microphone units 1, 2, 3 are disposed in parallel in a manner such that the main axes are located within a single holizontal plane. Further, vibrating plates of the respective microphone elements constituting the respective microphone units are disposed in a manner positioned within a single plane in parallel to the planes of these vibrating plates.

As the signal synthesis element 4, there is used so called a wired additive synthesis element in which respective signal lines to which outputs of the respective microphone units 1, 2, 3 are delivered are directly connected. As this signal synthesis element 4, a signal synthesis element adapted for carrying out signal synthesis through an amplifier may be also employed. From the signal synthesis element 4, an output in which outputs of the respective microphone units 1, 2, 3 are synthesized is provided.

Figure 3:
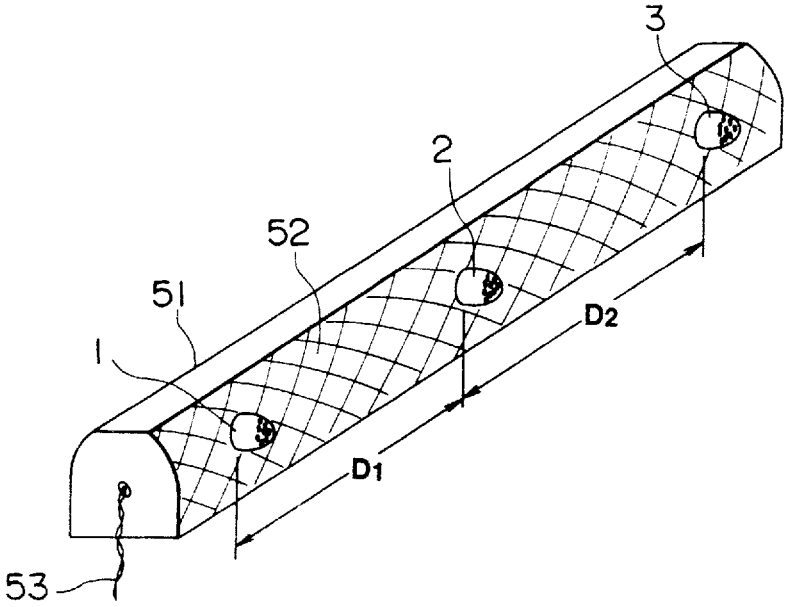
FIG. 3 is a perspective view showing an example where the microphone device according to this invention is applied to the voice input means of the speech recognition equipment used in the car navigation system.

Meanwhile, the microphone device of this embodiment is applied to the voice input means of the speech recognition equipment used in the car navigation system used in the state mounted in an automotive vehicle, which is adapted for receiving a reference signal from satellite to indicate the present (current) position on the map displayed on the display screen and to guide traveling direction. This microphone device comprises, in a more practical sense, as shown in FIG. 3, an elongated housing 51 which takes substantially rectangular shape in cross section. The respective microphone units 1, 2, 3 are attached in such a manner that main axes of directivities of the respective microphone units 1, 2, 3 are in parallel to each other in the state where the sound collection surface side where respective vibrating plates constituting the respective microphone elements are positioned is faced to the front side of the housing 51. In this case, spacings (distances) $D_1$, $D_2$ between respective microphone units 1, 2, 3 are set to 55 mm. In addition, the respective microphone units 1, 2, 3 are disposed in parallel to each other in such a manner that the main axes of directivities are positioned within a single horizontal plane.

In this example, the respective microphone units 1, 2, 3 are attached through a printed wiring board disposed within the housing 51. The synthesis element 4 is disposed on the printed wiring board. The respective microphone units 1, 2, 3 are (electrically) connected to the synthesis element 4 through the wiring pattern of the printed wiring board. Thus, respective outputs are caused to undergo additive synthesis by the synthesis element 4.

Further, the respective microphone units 1, 2, 3 are disposed within the housing 51 in such a manner that the vibrating plates of the respective microphone elements are positioned within a single plane in parallel to the planes of these vibrating plates. Namely, the respective microphone units 1, 2, 3 are disposed within the housing 51 in the state where the positions in forward and backward directions of the main axis direction are in correspondence with each other.

At the front side of the housing 51 to which the sound collection surface sides of the respective microphone units 1, 2, 3 are faced, a front plate 52 comprised of thin metallic plate or cloth member having a large number of small holes bored thereat is attached. This front plate 52 serves to absorb sound in order to prevent that sound incident (incoming) to the front side of the housing 51 is reflected and reflected sound is not incident to the respective microphone units 1, 2, 3. By providing such a front plate 52, the respective microphone units 1, 2. 3 can securely collect sound incident only to these microphone units 1, 2, 3.

Moreover, at one side surface of the housing 51, a lead-out wire 53 for taking out an output from the synthesis element 4 to the external is drawn out.

This microphone device is constituted so that it is applied to the voice input means of the speech recognition equipment used in the car navigation system used in the state mounted in an automotive vehicle, and is constituted at the position where sound produced by driver can be securely collected and the microphone device can be attached so that there results no obstacle in driving when disposed within an automotive vehicle. In the embodiment shown in FIG. 3, although not shown, attachment means such as clip or surface fastener, etc. for gripping sun visor is provided at the back side of the housing 51 in order that the microphone device can be attached at the surface of the sun visor for light shielding or dashboard, etc. arranged at the upper portion of the driver seat within the automotive vehicle.

In the microphone device of this embodiment, since the respective microphone units 1, 2, 3 are disposed within the housing 51 in the state where positions in forward and backward directions of the main axis direction are in correspondence with each other, it is possible to dispose them along the surface of the attachment member such as sun visor, etc. without protruding a portion thereof. Accordingly, even in the case where this microphone device is disposed within an automotive vehicle, it can be installed in a manner to sufficiently avoid risk without giving hindrance to driving by the driver.

In the case where the respective microphone units 1, 2, 3 are accommodated into the housing 51 of which back side is closed to constitute the microphone device, since incoming of sound from the back side is limited, not only uni-directional microphone unit but also bi-directional microphone unit may be used.

Figure 4:
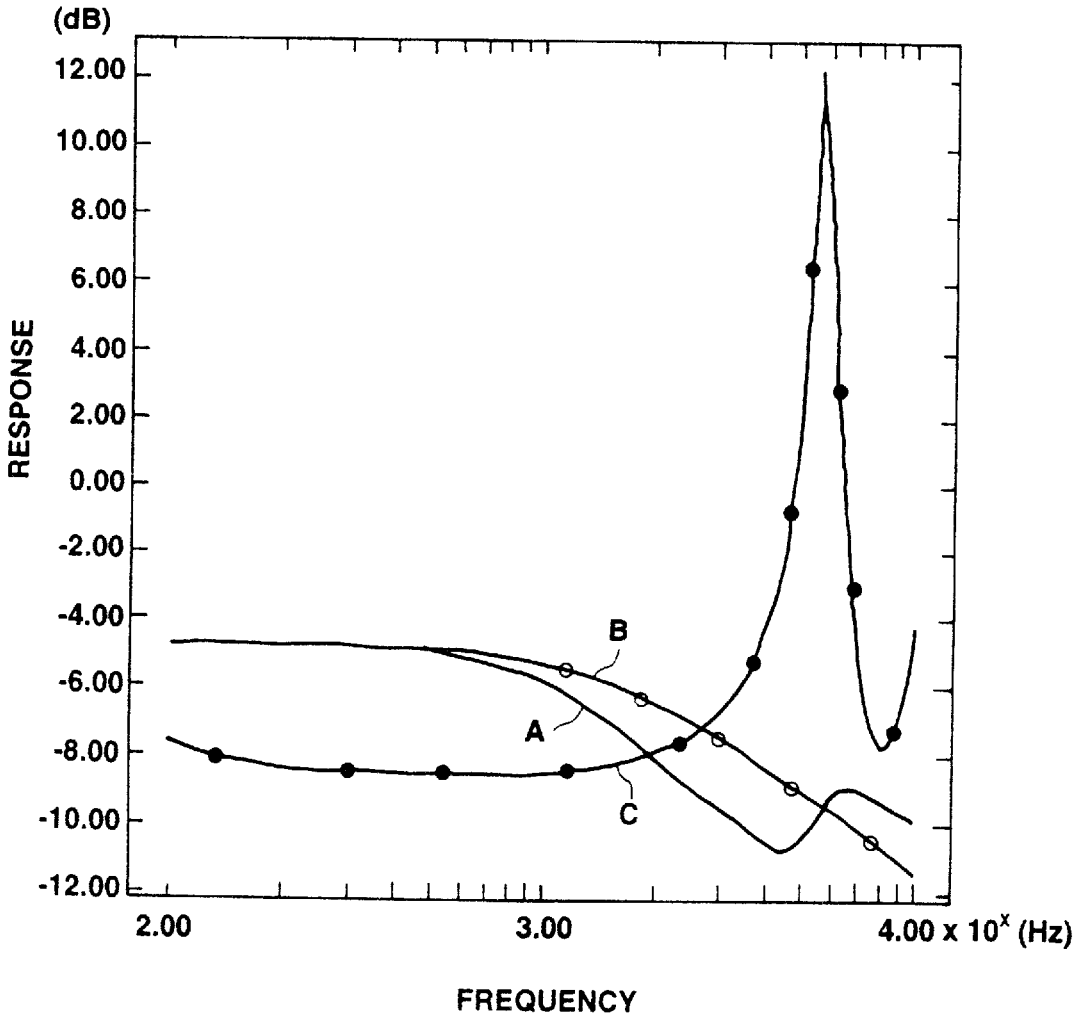
FIG. 4 is a characteristic diagram showing the directivity index frequency characteristic of the microphone device shown in FIG. 1 along with respective directivity index frequency characteristics of shot-gun microphone device and the secondary sound pressure gradient microphone device.

Meanwhile, as the result of the fact that directivity index which is one of evaluation quantities for numerically grasping directivity of the microphone device was calculated with respect to the microphone device in which respective microphone units 1, 2, 3 are disposed as shown in the FIGS. 1 and 2 previously mentioned, directivity index frequency characteristic A as shown in FIG. 4 was obtained. It is to be noted that, along with the directivity index frequency characteristic A of the microphone device of this embodiment calculated with the frequency characteristic of the non-directional microphone device being as reference, the directivity index frequency characteristic B of the previously described shot-gun type microphone device and the directivity index frequency characteristic C of the secondary sound pressure gradient type microphone device are shown in FIG. 4.

In this case, the ratio between energy response of the directional microphone with respect to such sound incident at the same probability from all directions and completely irregular in its phase and energy response of the non-directional microphone of which front sensitivity is equal to the above is called directional efficiency (efficiency of directivity). The directional efficiency is defined by the following formula.

$$\text{Directional efficiency} = \frac{1}{4\pi}\int_{D}^{4\pi} D^2(\Omega)d\Omega \tag{1}$$

In the above-mentioned formula, D(Ω) represents ratio between output voltage with respect to incident wave at angle Ω and that at Ω=0, and dΩ represents infinitesimal solid angle in the direction of angle Ω.

If the directivities are symmetrical with respect to the reference surface, the directional efficiency is given by the following formula (2).

$$\text{Directional efficiency} = \frac{1}{2}\int_{D}^{\pi} D^2(\theta)\sin\theta d\theta \tag{2}$$

Further, the directivity index is defined by the following formula (3).

$$\text{Directivity index}=10\log_{10}(\text{directional efficiency}) \tag{3}$$

or is defined by the following formula (4)

$$\text{Directivity index} = 10\log_{10}\frac{M_D^2}{M_{diff}^2} \tag{4}$$

In the above formula (4), $M_0$ is front sensitivity in the free sound field (plane wave) and $M_{diff}$ represents diffusion sound field sensitivity.

In this case, since the directivity index of the uni-directional microphone is −4.78 dB, the microphone device of this embodiment and the shot-gun type microphone device are as clear from FIG. 4 such that the directivity index, i.e., sharpness of the directivity in the low frequency band is the same order as that of the uni-directional microphone, but they exhibit sharp directivity in the medium frequency band. On the contrary, the secondary sound pressure gradient type microphone device presents (exhibits) sharp directivity in the low and medium frequency bands. Further, the microphone device of this embodiment exhibits sharp directivity as compared to the shot-gun type microphone device and the secondary sound pressure gradient type microphone device in the high frequency band.

As stated above, since the microphone device of this embodiment is adapted to carry out additive synthesis of outputs of the respective microphone units 1, 2, 3 at the synthesis element 4, output corresponding to sound wave inputted to the respective microphone units 1, 2, 3 is such that in-phase components are added and anti-phase components are canceled, and thus presents (exhibits) ultra directional property (characteristic) at the frequency dependent upon the spacing D between the respective microphone units 1, 2, 3.

Figure 5:
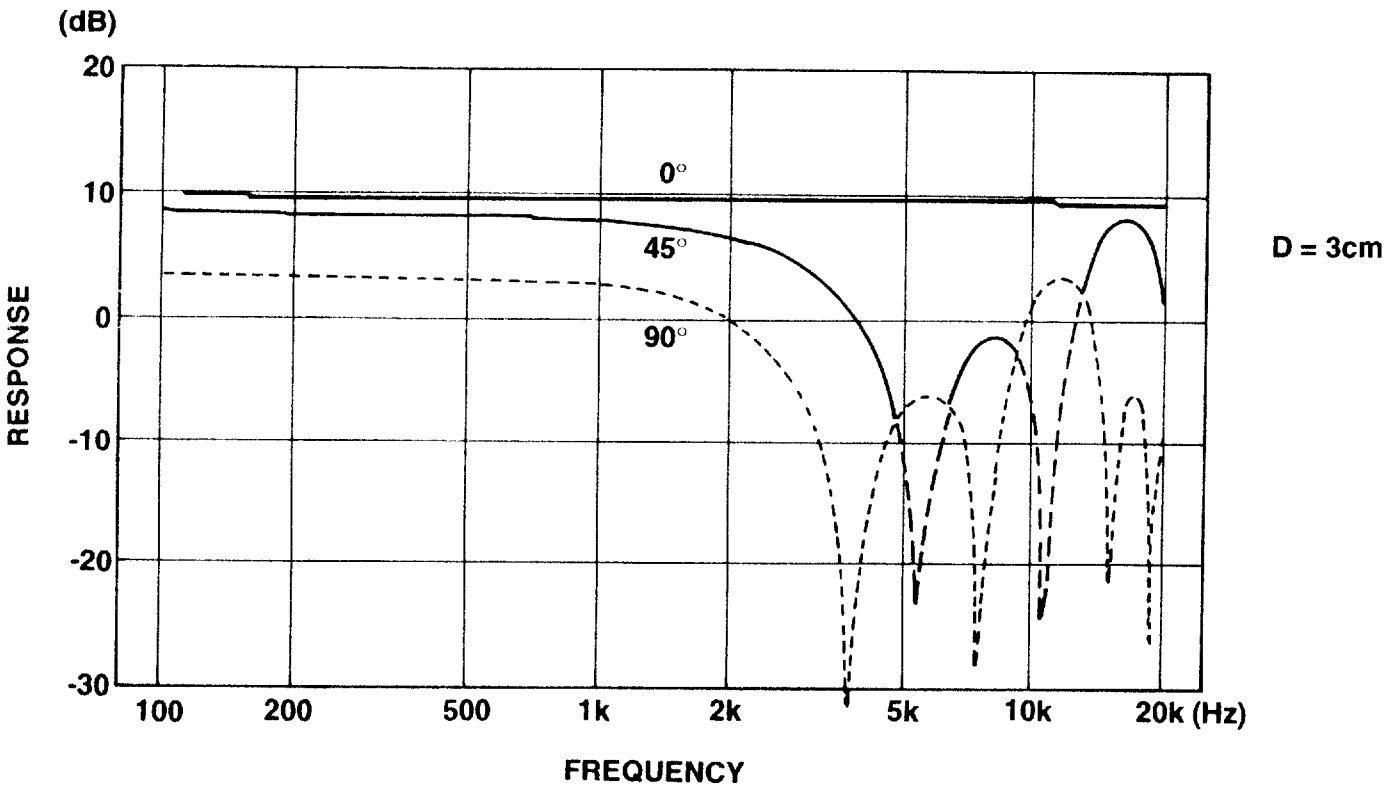
FIG. 5 is a characteristic diagram showing the directivity frequency characteristic in the case where the spacing between respective microphone units in the microphone device is set to 3 cm.
Figure 6:
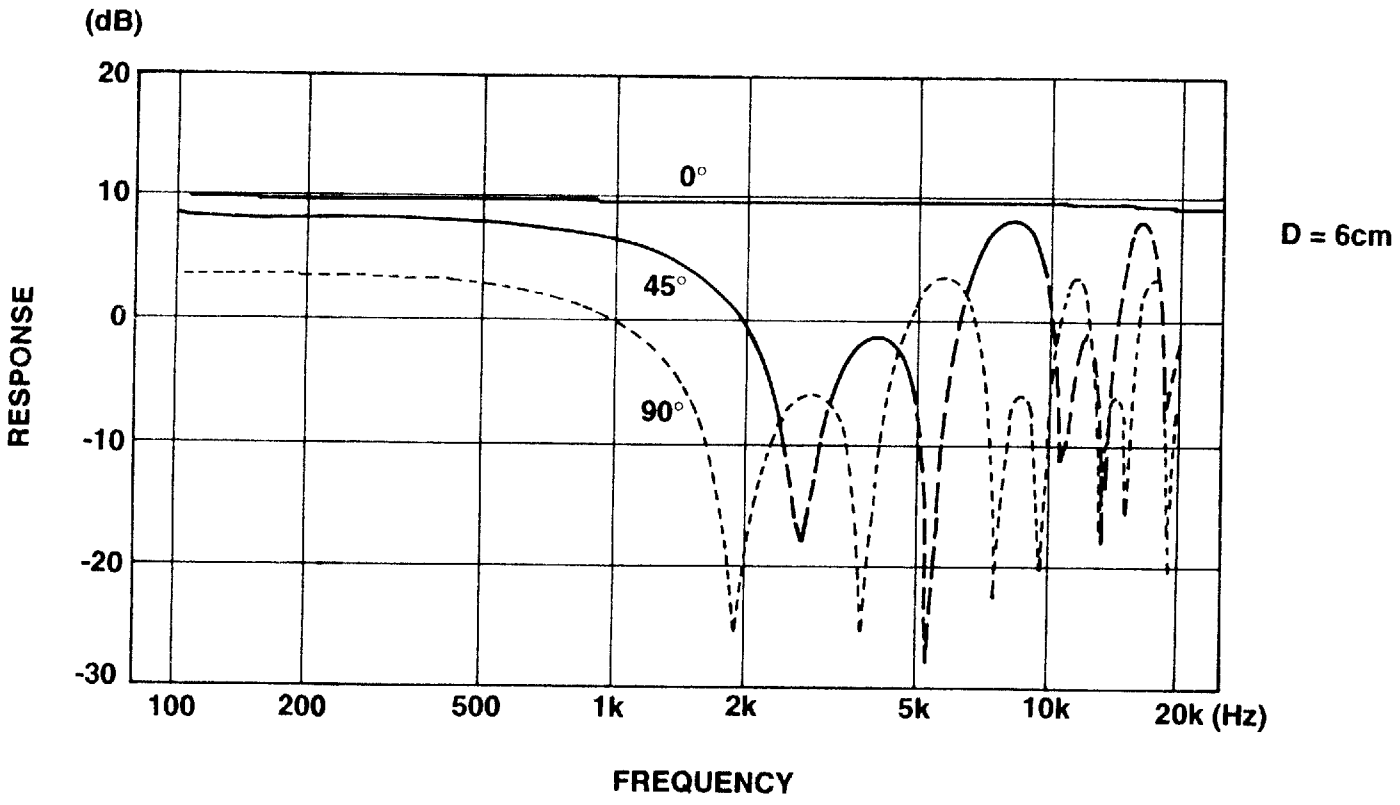
FIG. 6 is a characteristic diagram showing directivity frequency characteristic in the case where the spacing between respective microphone units in the microphone device is set to 6 cm.
Figure 7:
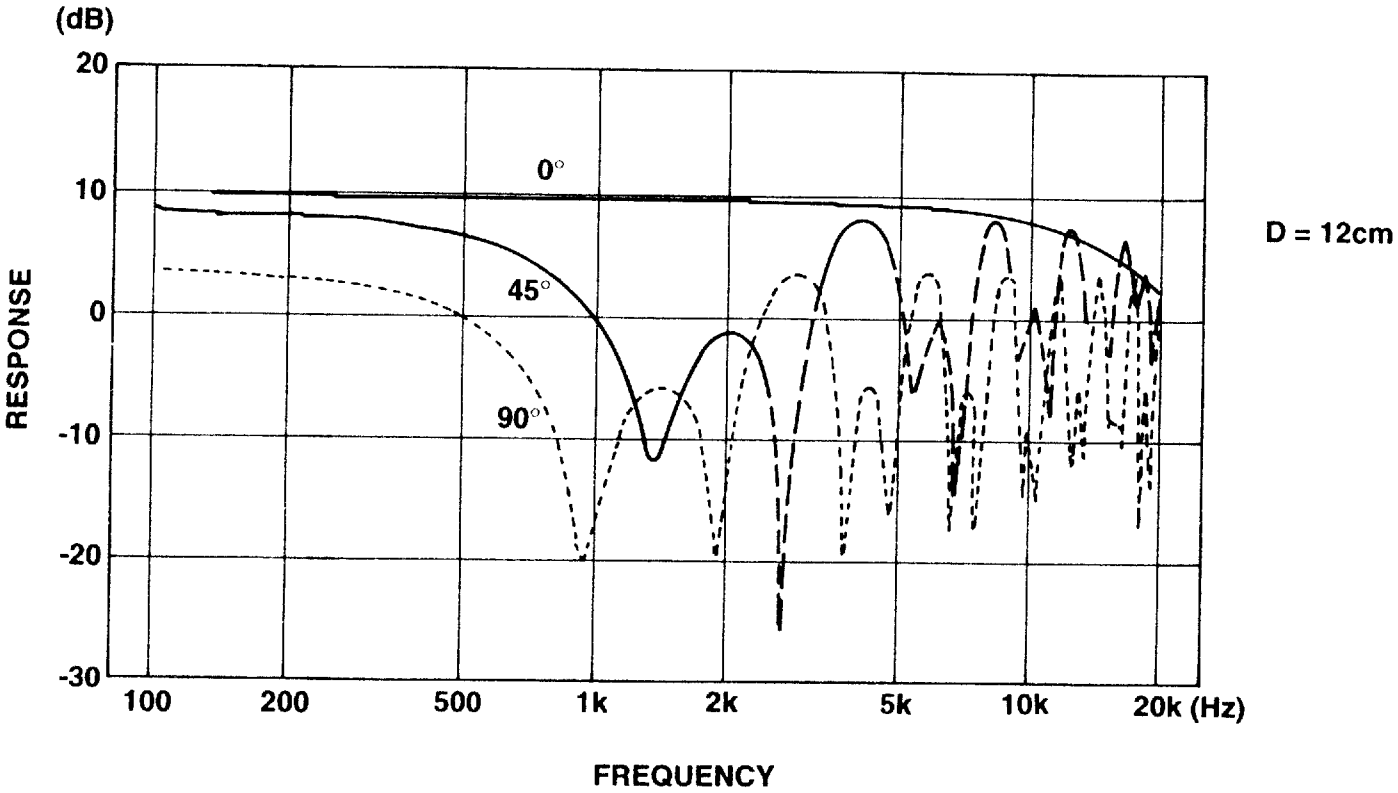
FIG. 7 is a characteristic diagram showing directivity frequency characteristic in the case where the spacing between respective microphone units in the microphone device is set to 12 cm.

In the microphone device of this embodiment, as the result of the fact that the spacing D between the respective microphone units 1, 2, 3 shown in FIG. 2 previously mentioned is varied, it exhibits a frequency characteristic as shown in FIG. 5 in the case where D is set to 3 cm; it exhibits a frequency characteristic as shown in FIG. 6 in the case where D is set to 6 cm, and it exhibits a frequency characteristic as shown in FIG. 7 in the case where D is set to 12 cm. Namely, when the spacing D is caused to fall within the range of 4 to 8 cm, it is possible to carry out sound collection which has high sensitivity with respect to speech (voice) input from the front and has extremely less noise from the side surface.

In this case, the frequency characteristic with respect to 40 degrees direction and 90 degrees direction relative to the main axis when the main axis direction is set to 0 degrees, i.e., the directivity frequency characteristic is shown in the FIGS. 5 and 7 previously mentioned.

Figure 8:
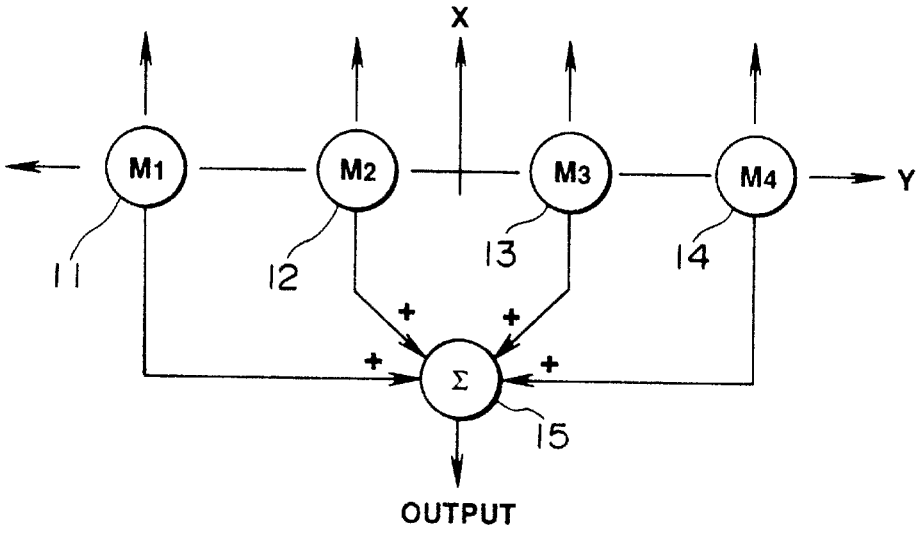
FIG. 8 is a block diagram showing another configuration of the microphone device according to this invention.

Moreover, the microphone device according to this invention may be composed, as shown in FIG. 8, for example, of four microphone units 11, 12, 13, 14, and a synthesis element 15 for carrying out additive synthesis of outputs of the respective microphone units 11, 12, 13, 14.

Also in the case of this example, microphone units which presents (exhibit) uni-directional property (characteristic) are respectively used as the respective microphone units 11, 12, 13, 14. In this example, the respective microphone units 11, 12, 13, 14 are disposed at equal intervals, e.g., at intervals of 6 cm in a direction perpendicular to the main axis of the directivity direction. The spacings (intervals) between these respective microphone units 11, 12, 13, 14 are suitably selected in correspondence with the size of the microphone unit used and/or the sound source used for sound collection. In addition, the respective microphone units 11, 12, 13, 14 are disposed in parallel so that the main axes are located within the single horizontal plane.

Figure 9:
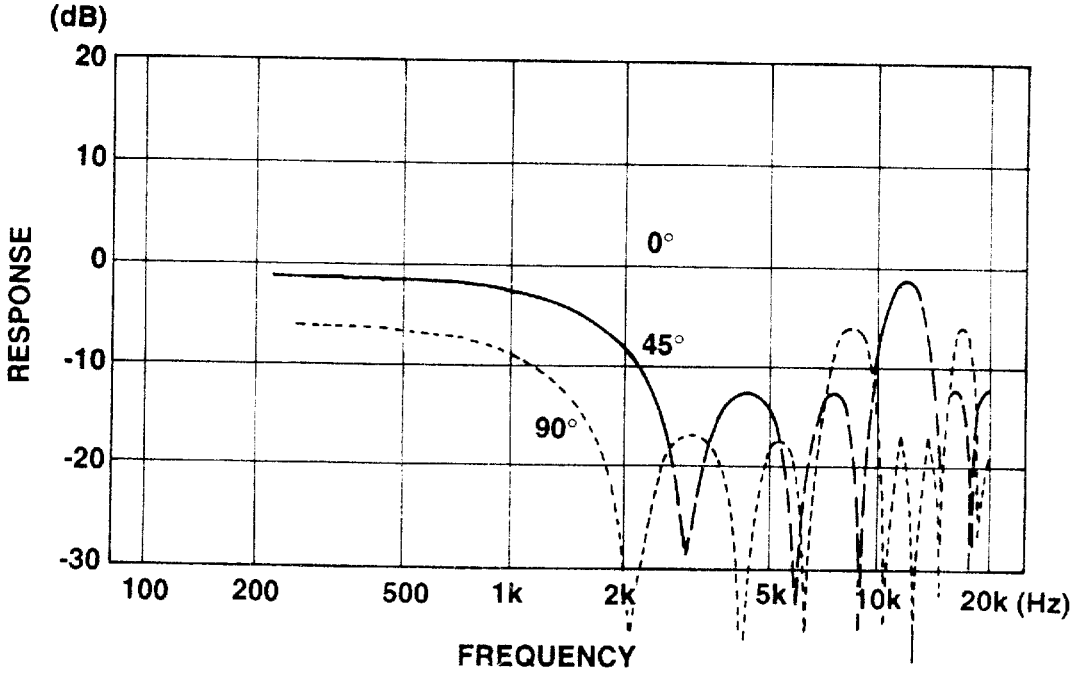
FIG. 9 is a characteristic diagram showing the directivity frequency characteristic in the case where the spacing between respective microphone units in the microphone device shown in FIG. 8 is set to 6 cm.

In accordance with the microphone device thus constructed, a directivity frequency characteristic as shown in FIG. 9 is obtained, and the number of microphone units provided in parallel is increased, whereby the directivity in the high frequency band becomes sharp.

Accordingly, plural uni-directional microphone units are provided in parallel in the state spaced to each other by predetermined distances in a direction perpendicular to the main axis of the directivity to carry out, at the synthesis element, additive synthesis of outputs of the respective microphone units to obtain an output signal, thereby making it possible to realize a microphone device in which directivity in the middle pitched tone (sound) region (range) which are major components of speech (sound spoken) of the human being is sharp.

Figure 10:
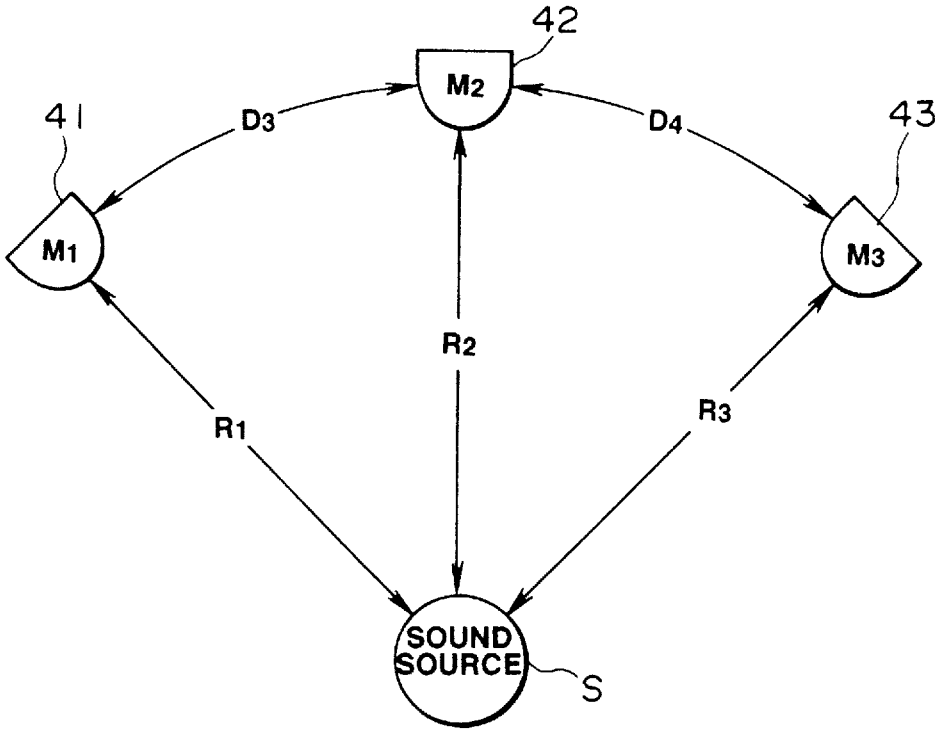
FIG. 10 is a block diagram showing a further configuration of the microphone device according to this invention.

Meanwhile, while, in the above-described respective embodiments, plural respective microphone units are disposed so that vibrating plates of respective microphone elements constituting these microphone units are positioned within a single plane in parallel to planes of these vibrating plates, three or four microphone units 41, 42, 43 may be arranged on the circumference so that they are positioned at equal distance $R_1=R_2=R_3$ with respect to the sound source S as shown in FIG. 10. Also in this case, respective spacings (distances) $D_3$, $D_4$ between the respective microphone units 41, 42, 43 are caused to be equal to each other.

Moreover, while plural respective microphone units are equidistantly disposed in the above-described respective embodiments, the spacings (intervals) between respective microphone units may be shifted (varied) within the range of about 1 to 1.2. Namely, deviation (shift) of about 1 to 1.2 with respect to the wavelength of speech of the human being can be considered as an allowable error with respect to the directivity. Therefore, such deviation does not constitute any problem in view of practical use, and does not impede the object of this invention.

Figure 11:
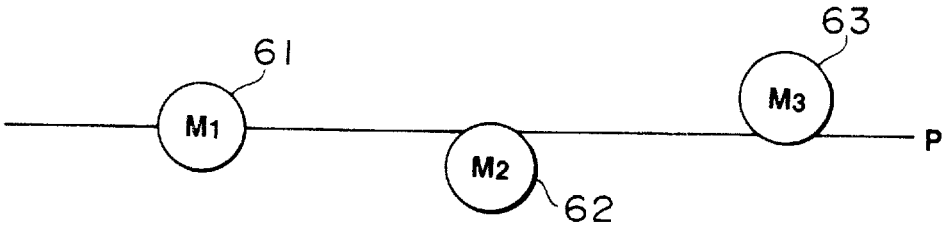
FIG. 11 is a block diagram showing a still further configuration of the microphone device according to this invention.

Further, with respect to plural, e.g., three microphone units 61, 62, 63, even if there exists any deviation (shift) which is the order of diameter of the microphone units 61, 62, 63 in upper and lower directions with respect to the horizontal plane P when viewed from the front in the arrangement direction as shown in FIG. 11, such deviation can be considered as an allowable error with respect to the directivity. This is not problem in view of practical use, and does not impede the object of this invention.

It is to be noted that in such cases that the microphone device according to this invention is used as the voice input means of the personal computer, it is desirable that the intervals (distances) between respective microphone units are caused to be large so that the directivity range is widened as compared to the case where it is used for the voice input means of the speech recognition equipment used in the car navigation system. The reason why such an approach is employed is that in the case where the personal computer is used, the head of user is moved to much degree. On the other hand, in the case where this microphone device is used as the car navigation system, movement of driver is restricted. For this reason, it is advantageous to allow the intervals (distances) between respective microphone units to be small because the sound collection characteristic is improved while improving the directivity.

In this case, in place of carrying out, at the synthesis element, additive synthesis of outputs of plural microphone units provided in parallel in the state spaced to each other by predetermined distances in a direction perpendicular to the main axis of the directivity, an approach may be employed to take sound waves into wave guide elements at the positions spaced to each other by the predetermined distance in a direction perpendicular to the main axis of the directivity to mix such sound waves to input mixed one to the microphone unit, thus making it possible to obtain an output signal from a single microphone unit.

Figure 12:
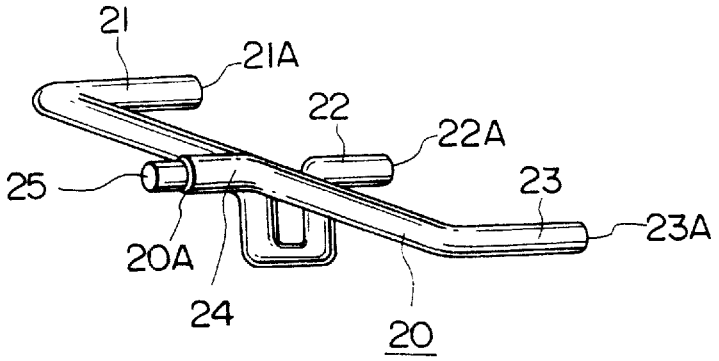
FIG. 12 a perspective view showing a still more further configuration of the microphone device according to this invention.

As this microphone device, a configuration as shown in FIG. 12 may be employed. This microphone device is composed of a wave guide element 20 in which three sound (acoustic) tubes 21, 22, 23 in which opening portions formed at one end side are caused to be sound wave introduction holes 21A, 22A, 23A are connected at the outgoing portion which is the opening portion side of the other end side, and a microphone unit 25 provided at an outgoing hole 20A of the wave guide element 20.

The respective sound tubes 21, 22, 23 are bent and formed so that the respective sound wave introduction holes 21A, 22A, 23A are located at positions spaced to each other by predetermined distances in a direction perpendicular to the main axis of the directivity. Further, the wave guide element 20 is adapted to mix respective sound waves incident (incoming) from the respective sound wave introduction holes 21A, 22A, 23A at a joint (connecting) portion 24 of the respective sound tubes 21, 22, 23 to allow it to be incident to the microphone unit 25. Namely, the respective sound tubes 21, 22, 23 respectively include the sound wave introduction holes 21A, 22A, 23A at positions spaced to each other by predetermined distances in the direction perpendicular to the main axis of the directivity, and is such that there are formed sound passage portions to introduce respective sound waves introduced from the sound wave introduction hole 21A, 22A, 23A to the joint portion 24 so that the joint portion 24 functions as a mixing portion for mixing respective sound waves.

In this case, these respective sound wave introduction holes 21A, 22A, 23A of the wave guide element 20 are arranged so that distances from the sound source are caused to be equal to each other and a single horizontal plane surface is formed. Namely, the respective sound wave introduction holes 21A, 22A, 23A are arranged so that they are positioned substantially on the same line or they are individually positioned on the circumference in which the sound source is caused to be center.

In the microphone device constructed in this way, respective sound waves incident (incoming) from the respective sound wave introduction holes 21A, 22A, 23A are mixed at the wave guide element 20, whereby in-phase components are added and anti-phase components are canceled. Accordingly, the ultra directional property (directivity) is exhibited at a frequency depending upon the intervals (distances) D between the respective sound wave introduction holes 21A, 22A, 23A. Thus, sharp directivity is realized in the middle pitched tone (sound) region (range). As a result, it is possible to carry out, by using only one microphone unit 25, sound collection which has high sensitivity with respect to speech (voice) input from the front and has extremely less noise from the side surface.

The microphone unit 25 used in the above-described microphone device is attached to the end portion of the wave guide element 20 and is adapted for collecting sounds incident (incoming) from the branched sound tubes 21, 22, 23. Accordingly, incoming of sound from, e.g. , the lateral direction except for the directions to which the respective sound wave introduction holes 21A, 22A, 23A are directed is limited. Thus, non-directional microphone unit can be used. In the case where the non-directional microphone unit is used, this microphone unit exhibits sensitivity also with respect to waves from the back side so that the directivity characteristic takes a form of eight (of figure). However, in such cases that this microphone device is used as the voice input means of the speech recognition device used in the car navigation system used when mounted in an automotive vehicle, the back side is substantially closed so that sound from the back side is hardly incident. Accordingly, the objective can be sufficiently attained.

It is to be noted that in the case where the non-directional microphone unit 25 is used, since impedance of the sound tubes 21, 22, 23 is higher than that of the microphone unit 25, it is desirable for establishing matching with impedance of the sound tubes 21, 22, 23 to close the back side of the microphone unit 25 to carry out adjustment of impedance.

Moreover, in the case where a uni-directional microphone unit is used as the microphone unit 25, there results no collection of sound incoming from the back side. Accordingly, the microphone unit is permitted to have the characteristic similar to that of the previously described microphone unit shown in FIG. 1.

Figure 13:
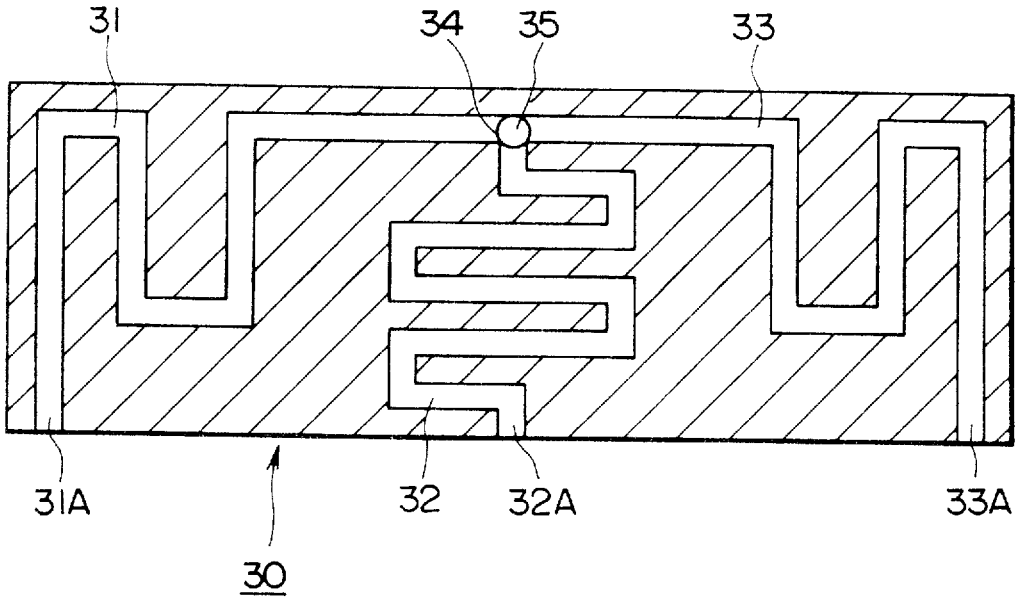
FIG. 13 is a lateral cross sectional view showing the essential part of a further different configuration of the microphone device according to this invention.

Further, in place of the wave guide element 20 constituted with sound tubs 21, 22, 23 as described above, as in the case of a microphone device shown in FIG. 13, for example, there may be used a wave guide element 30 including sound passage portions 31, 32, 33 for introducing (guiding) sound waves respectively introduced from sound wave introduction holes 31A, 32A, 33A, which are formed at positions spaced to each other by predetermined distances D in a direction perpendicular to the main axis of the directivity, and a mixing portion 34 for mixing respective sound waves introduced through the respective sound passage portions 31, 32, 33 to install (provide) a microphone unit 35 at the mixing portion 34 of the wave guide element 30. It should be noted that distances of the respective sound passage portions 31, 32, 33 from the sound wave introduction holes 31A, 32A, 33A to the mixing portion 34 are caused to be equal to each other, whereby the mutual phase relationship between respective sound waves introduced from the sound wave introduction holes 31A, 32A, 33A is maintained. As a result, in-phase components are added and anti-phase components are canceled by the mixing portion 34.

INDUSTRIAL APPLICABILITY

In accordance with the microphone device according to this invention, outputs of at least three uni-directional microphone units disposed in a manner spaced to each other by predetermined distances in a direction perpendicular to the main axis of the directivity are caused to undergo additive synthesis at the synthes element to thereby obtain an output signal. Thus, sharp directivity is realized in the middle pitched tone (sound) region (range), and sound collection which has high sensitivity with respect to voice input from the front and has extremely less noise from the lateral direction can be carried out. Accordingly, this microphone device is used as the voice input means of the speech recognition equipment used in the car navigation system used when mounted in an automotive vehicle, or the voice input means of the computer, thereby making it possible to precisely and securely carry out collection of speech of driver or operator.

We claim:

1. A microphone device, comprising:

three directional microphone elements disposed in a substantially horizontal linear array on sound absorbing mounting means forming a first vertical plane, whereby adjacent ones of the three microphone elements are separated by a single predetermined distance, each of the three microphone elements is directed to a sound source, and three sound receiving faces, each corresponding to one of the three microphone elements, form a plane parallel to the first vertical plane formed by the sound absorbing mounting means, said plane parallel to the first vertical plane being between the first vertical plane and the sound source; and adding means for adding output signals from respective ones of the three microphone elements;

wherein each of the three microphone elements includes a vibrating plate; and wherein the first vertical plane is in parallel to a second vertical plane formed by the vibrating plates.

2. The microphone device as set forth in claim 1, wherein each of the three microphone elements is a uni-directional microphone element.

3. A microphone device, comprising:

three microphone elements disposed on sound absorbing mounting means whereby adjacent ones of the three microphone elements are separated by a single predetermined distance, each of the three microphone elements is mounted in a horizontal linear array configuration substantially perpendicular to a main axis of directivity of the three microphone elements and three sound receiving faces, each corresponding to one of the three microphone elements, form a vertical plane; and adding means for adding output signals from respective ones of the three microphone elements;

wherein the three microphone elements are comprised of unidirectional microphone elements and are disposed on said sound absorbing mounting means such that each of three sound collection surfaces corresponding to one of the three microphone elements is directed in the same direction with respect to a sound source and such that each of the three microphone elements is between said sound absorbing mounting means and said sound source.

4. A microphone device, comprising:

a microphone element; and three sound guide paths substantially equal to each other in length and adapted for guiding external sound to the microphone element, wherein respective first and second open ends of each of the three sound guide paths are arranged so that each one of three distances from a single sound source to the microphone element through one of the three sound guide paths is caused to be equal to the other two distances, the first open ends of each of the three sound guide paths form a horizontal linear array, and the second open ends of the three sound guide paths are adjacent the microphone element.

5. The microphone device as set forth in claim 4, wherein the microphone element is a non-directional microphone element.

6. The microphone device as set forth in claim 4, wherein the microphone element is a uni-directional microphone element.

7. The microphone device as set forth in claim 4, further comprising sound absorbing means provided adjacent the three first open ends of the three sound guide paths.

* * * * *